US010055946B2

(12) United States Patent
Gelonese et al.

(10) Patent No.: US 10,055,946 B2
(45) Date of Patent: Aug. 21, 2018

(54) ENERGY INFORMATICS DISPLAY DEVICE AND METHOD

(71) Applicant: Embertec Pty Ltd, Dulwich, South Australia (AU)

(72) Inventors: Domenico Gelonese, Dulwich (AU); Nathan Kuchel, Dulwich (AU)

(73) Assignee: EMBERTEC PTY LTD (AU)

( * ) Notice: Subject to any disclaimer, the term of this patent is extended or adjusted under 35 U.S.C. 154(b) by 66 days.

(21) Appl. No.: 15/007,717

(22) Filed: Jan. 27, 2016

(65) Prior Publication Data

US 2016/0215960 A1 Jul. 28, 2016

(30) Foreign Application Priority Data

Jan. 28, 2015 (AU) ..... 2015900237

(51) Int. Cl.

| | |
|---|---|
| ***G08B 5/36*** | (2006.01) |
| ***F21V 7/00*** | (2006.01) |
| ***F21V 13/04*** | (2006.01) |
| ***F21K 9/62*** | (2016.01) |
| *F21Y 115/10* | (2016.01) |
| *F21W 111/00* | (2006.01) |

(52) U.S. Cl.

CPC ..... *G08B 5/36* (2013.01); *F21K 9/62* (2016.08); *F21V 7/0066* (2013.01); *F21V 13/04* (2013.01); *F21W 2111/00* (2013.01); *F21Y 2115/10* (2016.08)

(58) Field of Classification Search

CPC ..... G02B 6/0021; G08B 5/36; F21K 9/62

USPC ..... 340/815.42, 815.45, 815.5, 340/815.73–815.76

See application file for complete search history.

(56) References Cited

U.S. PATENT DOCUMENTS

| | | | | |
|---|---|---|---|---|
| 7,622,822 | B2 | 11/2009 | Gelonese | |
| 8,190,940 | B2 | 5/2012 | Gelonese | |
| 8,301,914 | B2 | 10/2012 | Gelonese | |
| D700,579 | S | 3/2014 | Mobbs | |
| 8,963,086 | B2 | 2/2015 | Gelonese et al. | |
| D726,107 | S | 4/2015 | Mudge et al. | |
| 9,106,099 | B2 | 8/2015 | Gelonese | |
| 2007/0153536 | A1* | 7/2007 | Mathieu | B60R 1/12 362/494 |
| 2008/0106148 | A1 | 5/2008 | Gelonese | |
| 2009/0235107 | A1 | 9/2009 | Gelonese | |
| 2010/0095146 | A1 | 4/2010 | Gelonese | |
| 2012/0080949 | A1 | 4/2012 | Gelonese | |
| 2012/0312989 | A1 | 12/2012 | Gelonese | |
| 2013/0063974 | A1* | 3/2013 | Hong | G02B 6/002 362/608 |
| 2013/0073705 | A1* | 3/2013 | Hester | H04L 12/2809 709/223 |

(Continued)

FOREIGN PATENT DOCUMENTS

| | | | |
|---|---|---|---|
| WO | WO 2005/111766 | A1 | 11/2005 |
| WO | WO 2008/064410 | A | 6/2008 |

*Primary Examiner* — Anh Mai
*Assistant Examiner* — Michael Chiang
(74) *Attorney, Agent, or Firm* — Craig A. Fieschko, Esq.; DeWitt Ross & Stevens S.C.

(57) ABSTRACT

An electronic device having a light display for communicating messages to a user wherein the light display is a rectangular halo produced by several discrete light sources where the combined width of all the light sources is small in comparison to the length of the perimeter of the rectangular halo.

9 Claims, 5 Drawing Sheets

(56) References Cited

U.S. PATENT DOCUMENTS

| | | | | |
|---|---|---|---|---|
| 2013/0163282 | A1* | 6/2013 | Kunimochi | G02B 6/0011 362/611 |
| 2014/0197960 | A1* | 7/2014 | Taylor, Jr. | G08B 5/36 340/815.45 |
| 2014/0254196 | A1* | 9/2014 | Moriyama | F21S 48/215 362/611 |
| 2014/0285019 | A1 | 9/2014 | Gelonese | |
| 2014/0292289 | A1 | 10/2014 | Gelonese | |
| 2014/0310744 | A1 | 10/2014 | Gelonese | |
| 2015/0039429 | A1 | 2/2015 | Gelonese | |
| 2015/0097666 | A1* | 4/2015 | Boyd | F24F 11/30 340/517 |
| 2015/0097686 | A1* | 4/2015 | Fadell | F24F 11/30 340/632 |
| 2015/0168626 | A1* | 6/2015 | Schinagl | G02B 6/0006 362/555 |
| 2015/0256032 | A1 | 9/2015 | Gatto | |
| 2015/0294540 | A1* | 10/2015 | Hori | B60K 35/00 340/815.45 |
| 2015/0338238 | A1 | 11/2015 | Gelonese | |
| 2015/0349532 | A1 | 12/2015 | Gelonese | |
| 2015/0364283 | A1* | 12/2015 | Hirose | H01H 50/08 335/202 |
| 2016/0062440 | A1 | 3/2016 | Gelonese | |
| 2016/0099571 | A1 | 4/2016 | Gelonese | |
| 2016/0215960 | A1 | 7/2016 | Gelonese | |
| 2016/0223601 | A1 | 8/2016 | Gelonese | |

* cited by examiner

ENERGY INFORMATICS DISPLAY DEVICE AND METHOD

FIELD OF THE INVENTION

The invention relates to the field of display of energy usage, energy demand and energy saving information, and to light displays able to produce a light with a halo effect from individual light sources for imparting information regarding the function and state of an electronic device.

BACKGROUND

The following references to and descriptions of prior proposals or products are not intended to be and are not to be construed as statements or admissions of common general knowledge in the art. In particular, the following discussion does not relate to what is commonly or well known by the person skilled in the art, but may assist in the understanding of exemplary versions of the present invention, to which the identification of pertinent prior proposals may be relevant.

In Home Displays (IHDs) are devices which, at their most basic, display to a householder the amount of electrical energy being consumed by the household at an instant in time. IHDs are becoming more common in homes as a way to illustrate to householders what or how much energy they are using at a particular point in time.

The expectation has been that householders will use this information to change behaviour and appliance use habits in order to save energy and hence money.

Also becoming more common in domestic premises are energy management hubs. These devices accumulate information about energy use in a home, and control or facilitate the control of appliances in order to save energy. These energy management hubs may also communicate with external entities such as energy retailers/providers/sources in order to determine energy costs and make or suggest changes in appliance use which lower or minimize energy costs.

These devices are designed to operate autonomously, since the greater the burden on a householder to achieve energy saving outcomes, the greater is the likelihood that a householder will not participate or will not adjust their behaviours.

These devices need an easy way in which to immediately (substantially in real time) communicate to a householder basic information such as excessive energy use and available opportunities for saving money, or simply that everything is going well or otherwise operating normally or within specifications.

Communication with the householder can be undertaken using lights, where information is encoded into such characteristics as light colour or flashing behaviour.

Such lights can be concentrated around a circular button or circular control surface. Thus users have become habituated to the idea that a circular light effect is associated with a control that requires attention. However, with fully autonomous devices, or devices which do not have a local user interface, this association is no longer correct. That is, a light effect may be providing certain information without necessarily inviting input via a user interface (such as by pressing a button), but rather may be intended to advise the user on current or anticipated states so that the user can make more informed decisions regarding future behaviour.

SUMMARY OF THE INVENTION

An electronic device, which may be an IHD, an energy management hub, a home automation hub, or any other electronic device, may be provided for household, personal, or other use.

The device may have no local user interface able to be manipulated by a user, or the local interface may not be the only or the primary way in which the function of the device is observed or controlled. The device includes a light display for communication of status information to a user. The device may be (for example) square or rectangular, in part to make it easier or more economical to manufacture. For example, printed circuit boards (PCBs) are generally made rectangular by default, and cutting PCBs to fit a round enclosure wastes material. A square or rectangular shape is often preferred for a device which is to sit on a flat surface, since it will be stable in any orientation.

Where the device has no local physical user interface, it may be preferred that the device not appear to be a "push button," which may happen if the light display is circular. A "push button" appearance may cause a user to attempt to push the apparent button, becoming frustrated when this has no effect.

To avoid a "push button" appearance and/or for other reasons of aesthetics and manufacturing and user convenience, a square or rectangular electronic device, with a corresponding square or rectangular light display is provided.

In one exemplary version, an electronic device includes a light display for communicating messages to a user wherein the light display is a rectangular halo, or a light of substantially uniform intensity around the periphery of a structure or component of the electronic device.

Preferably, the light is provided by a set of discrete light sources, spaced apart such that the combined width of all the light sources is a small proportion (such as 25 percent or 15 percent) of the length of the perimeter of the rectangular halo.

The light sources may be light emitting diodes (LEDs).

Preferably there is a light diffuser which includes refractive and reflective elements which, in combination with the light sources, produces the rectangular halo.

The rectangular halo may be a square halo.

In other exemplary versions, the invention may be said to be a method of creating a substantially continuous unbroken band of light in the outline of a square, the method including uniformly dispersing light from several discrete sources.

Exemplary versions of the invention may be said to lie in a hub device for domestic energy management having a light display for communicating status messages wherein the light display is a rectangular halo.

DETAILED DESCRIPTION OF EXEMPLARY VERSIONS OF THE INVENTION

Figure 1:
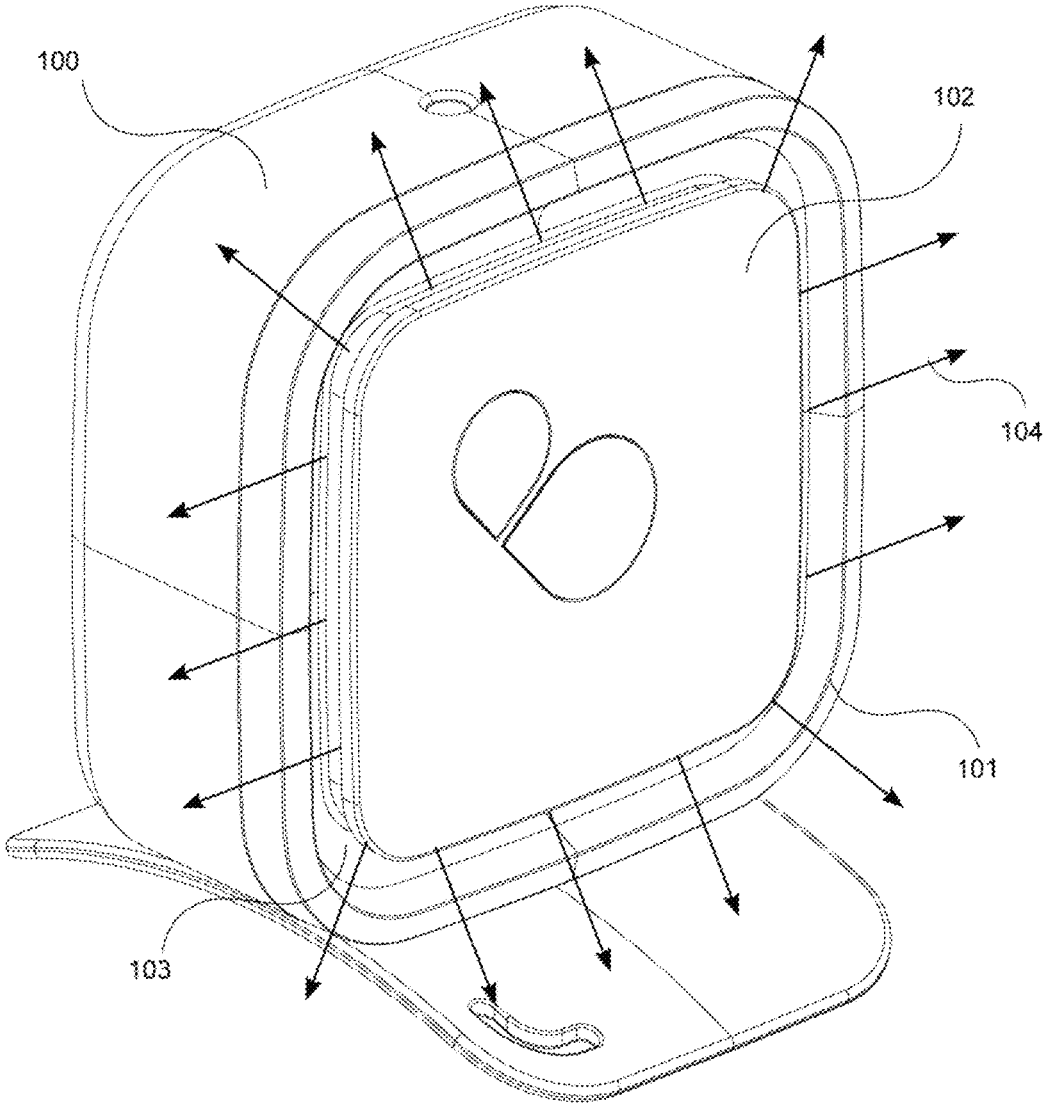
FIG. 1 shows an electronic device (such as a home energy management hub) including an exemplary version of the invention having a square halo light.

Referring now to FIG. 1, there is provided an electronic device, a Home Energy Management Hub ("hub") 100. The hub 100 is substantially square shaped, but in other versions may be any other rectangular shape. The hub 100 includes a front bezel 101 and a front cover plate 102. A void 103 is created between the front bezel 101 and the front cover plate 102. This void 103 is lit to provide a rectangular halo 104, or a substantially continuous band of light in the outline of a rectangle, which in this case is a square (which may have rounded corners).

To create light halos, such as the square halo 104 of FIG. 1, from discrete light sources is difficult because the light sources will necessarily be different distances from corners of the square than they are from sections of the edge of the square, due to the underlying square geometry. This causes uneven distribution of light around the square, resulting in areas of relatively brighter light and areas of relatively darker light, which gives an unattractive, uneven effect, rather than a continuous rectangular halo effect. The usual techniques of light dispersion, such as, simple light pipes, do not easily solve this issue, as the basic problem remains of the inconsistent distances between light source and light display area.

Figure 2:
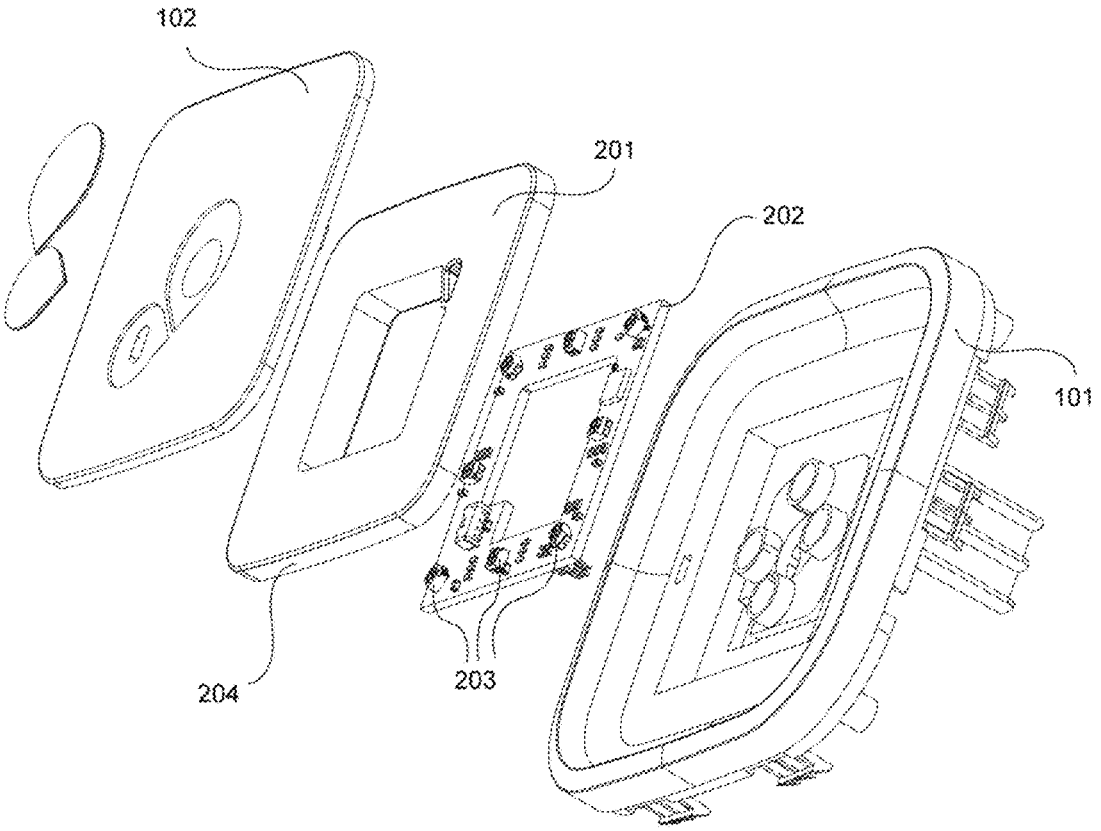
FIG. 2 shows an exploded view of the components of an exemplary system such as the one depicted in FIG. 1.

FIG. 2 is a partial exploded view of the hub 100 showing the elements of the hub 100 which create the rectangular halo effect 104.

There is the front bezel 101, which supports LED printed circuit board (PCB) 202. The LED PCB 202 is a PCB upon which (for example) eight LED light sources 203 are mounted. The LED PCB 202 provides general support and control (through programming and/or hardwiring) for the LEDs 203 that provide the light sources for the rectangular halo 104, such as turning the LEDs on and off (and the timing thereof), intensity of the lights, etc., based on various signals and inputs. In the illustrated version the LEDs 203 are arranged with one LED at each of the corners of a square and one LED in the middle of each side of the square defined by the corner LEDs.

There is a light diffuser 201, which is made of a translucent (semi-transparent) material. The edge 204 of the light diffuser 201 provides the apparent light source for the rectangular halo effect.

There is a front cover 102, which serves to prevent light from emitting from the front face of the light diffuser 201. The front cover 102 also serves to partly conceal the light diffuser 201 when viewed from the front of the device 100. The front cover 102 is larger in area than the light diffuser 201, but smaller in area than the front bezel 101. When assembled, the gap between the front cover 102 and the front bezel 101 defines the void 103 in which the rectangular halo effect appears.

Figure 3:
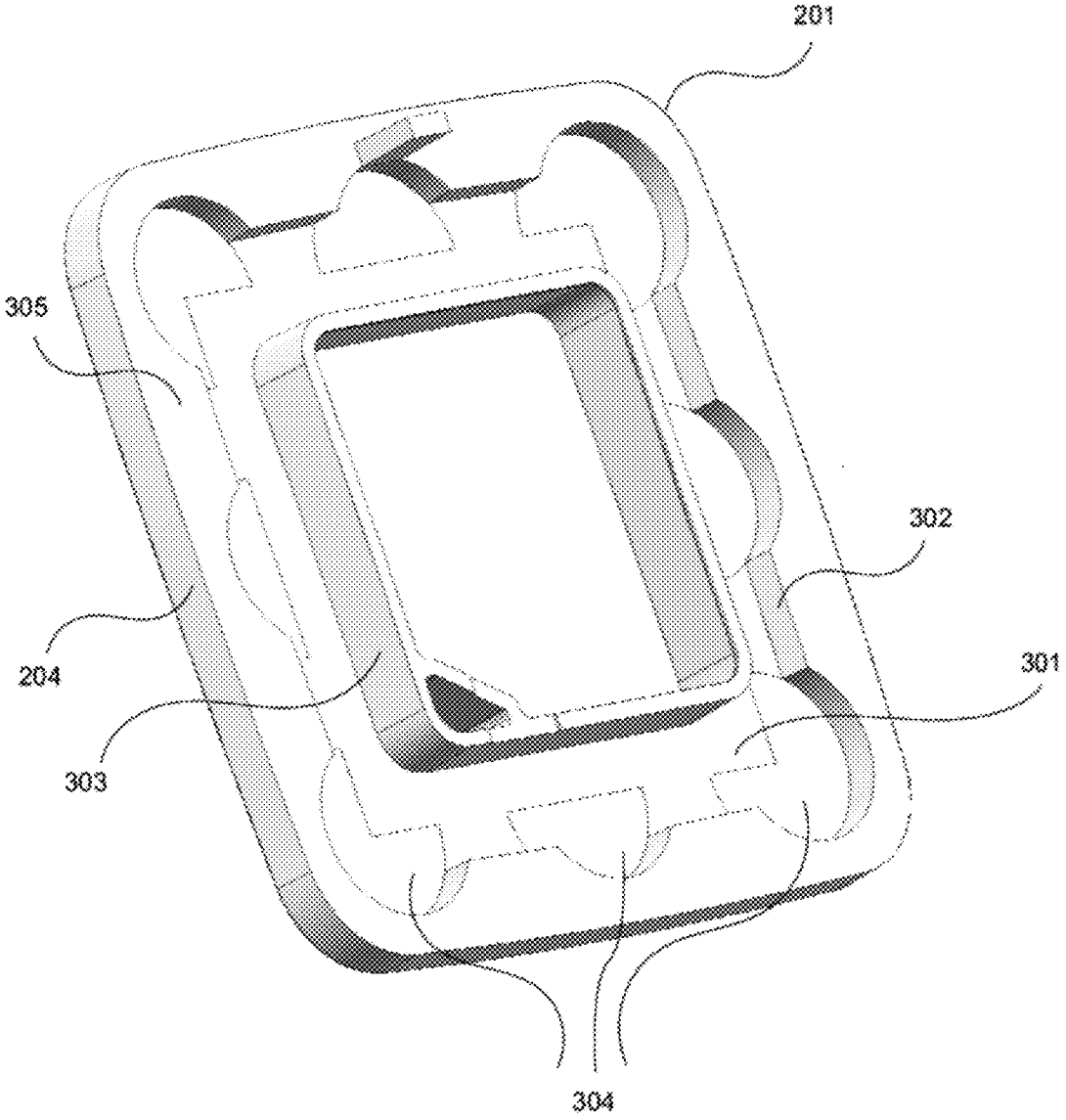
FIG. 3 shows a bottom perspective view of an exemplary light diffuser.

FIG. 3 is a rear view of the light diffuser 201. The light diffuser 201 is made of a translucent material. The light diffuser 201 consists of an outer rim 305, which is bounded in part by the edge 204 which is the apparent source of the rectangular halo 104. Inwards of the rim 305, there is a surface 301, which may be flat and which is preferably painted or otherwise coated to form an opaque, reflective surface (which is preferably diffusely reflective). There is an inner lip 303, which also has an opaque or reflective surface (which can also be diffusely reflective). The inner wall 302 of the rim is not coated, and remains translucent, allowing light to pass through to the edge 204.

The thickness of the rim 305 varies along its perimeter, with indentations 304 varying the rim width.

Figure 4:
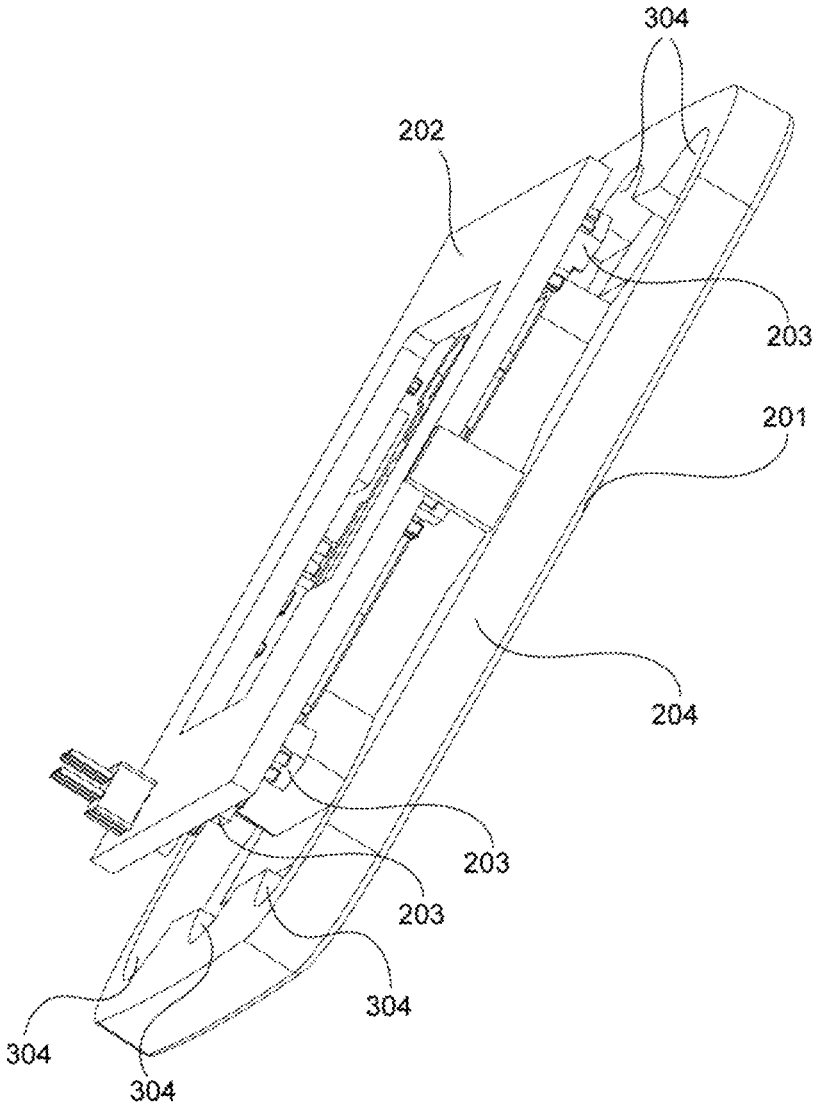
FIG. 4 shows an exemplary LCD PCB assembled with the light diffuser of FIG. 3.

FIG. 4 shows a rear view of the light diffuser 201 assembled with the LED PCB 202. The LED PCB 202 is assembled adjacent to the light diffuser 201. The LEDs 203 are adjacent to the rim indentations 304. It can be seen that there exists a gap (space or separation) between the light diffuser 201 and the LEDs 203. The LEDs 203 thus do not touch, nor are they closely abutted to, the light diffuser.

It can be seen that the LEDs 203 face towards the underside 301 of the light diffuser 201. The LEDs 203 preferably do not point directly towards the rim edge 204 from which the light forming the rectangular halo 104 emits, but rather (for example) upwards or inwards. This means the light from the LEDs 203 would not be aimed directly at the rim edge 204, and the light would primarily take a reflected and/or refracted (indirect) route to get to the rim edge 204 where the rectangular halo 104 is formed.

In use, the LED light may first strike the underside 301 of the light diffuser 201. The underside 301 of the light diffuser 201 is coated with reflective material, thus the light is reflected back into the space between the LED PCB 202 and the light diffuser 201.

The rim 305 of the light diffuser 201 is of a translucent refractive material. For light to travel to the edge 204 where the rectangular halo 104 is emitted, it passes through this refractive material, which disperses the light further.

Figure 5:
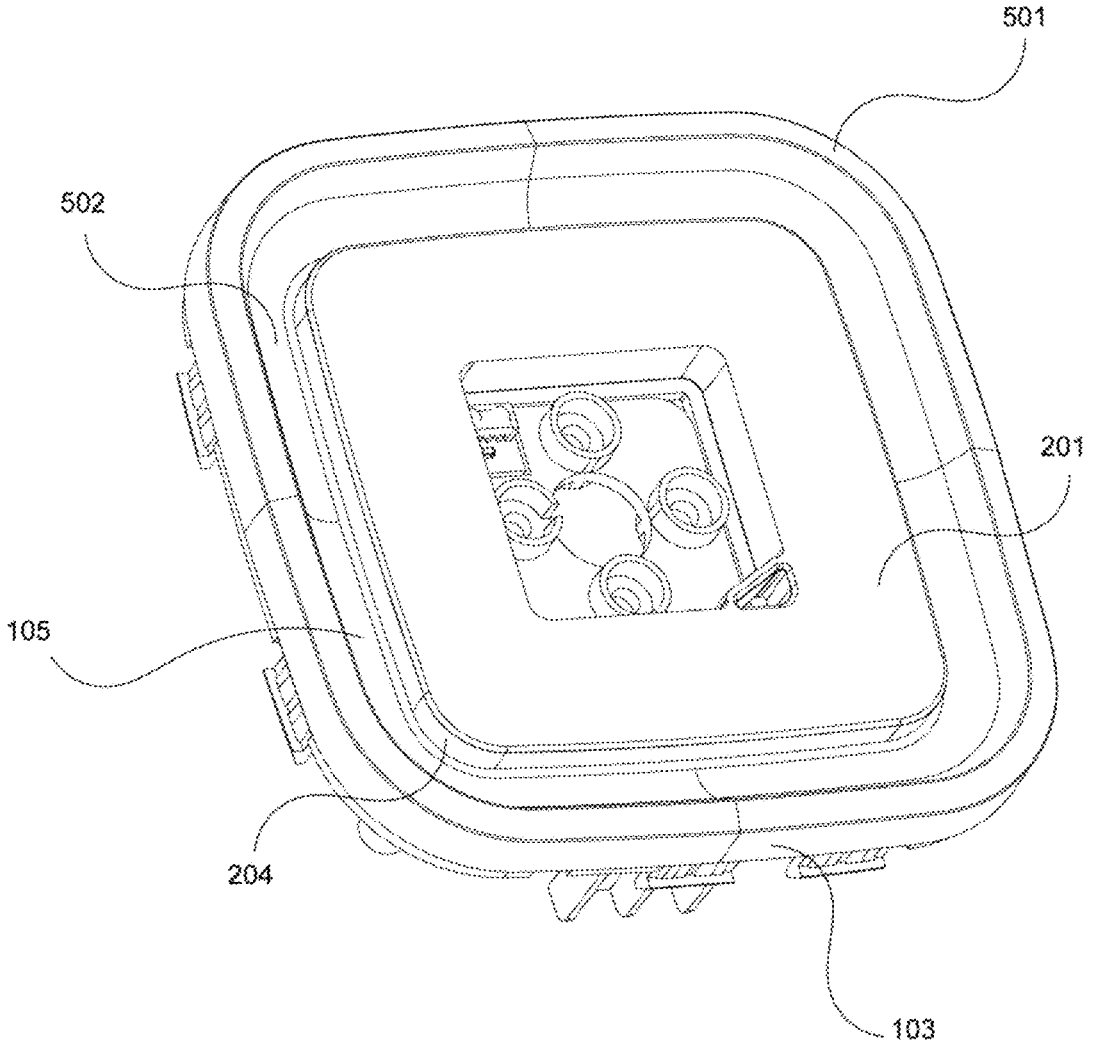
FIG. 5 shows an exemplary front bezel assembled with the light diffuser of FIG. 3.

FIG. 5 shows a view of the light diffuser 201 assembled to the front bezel 101. The front bezel 101 includes a bezel rim 501 which rises to approximately the same height as the assembled position of the front surface of the light diffuser 201. The inside surface 502 of the rim 501 may be curved. This surface 502, along with the edge 204 of the light diffuser, define the void 103 in which the rectangular halo 104 appears when the light from the LEDs is emitted from the light diffuser edge 204.

In order for the halo 104 to be seen the emitted light is reflected into the observer's eyes. This last reflection is from the inner curved surface 502 of the front bezel. In a preferred version, the front bezel 101 has a glossy black finish. In order for the reflection to be more clearly seen, a texture may be applied to the curved inner rim surface 502.

By combining multiple methods of light dispersion, including altering the initial direction of the light, reflection and refraction, many different paths for the light to travel from source to the rectangular halo 104 are created. For any given area on the rectangular halo 104, the light reaching it has travelled across several paths, which each represents a different combination of source, initial light direction, reflection and refraction. Taken together as a sum, the intensity of light reaching any section of the rectangular halo 104 is approximately the same amount as at any other section of the rectangular halo 104. That is, the light distribution around the rectangular halo 104 is approximately even, such that the light would be perceived to be of substantially uniform brightness around the rectangle to the naked eye of a user with normal eyesight.

As can be seen, an individual beam of light arriving at a given point on the rim edge 204 has derived from any of multiple sources located different distances from that point on the rim edge 204, has been reflected an indeterminate number of times, and has then arrived at the point on the rim edge 204 via any one of numerous paths through the refractive material of the light diffuser 201. Multiple beams of light will arrive at the same given point on the rim edge 204, all having arrived by different combinations of source and routes. The sum total of all these beams will, over the entirety of the rectangular halo 104, be approximately even, leading to an even intensity of illumination on the rim edge 204. The even light emitting from the rim edge 204 gives rise to an even rectangular halo effect.

In the illustrated version the light sources 203 are LEDs, but any suitable technology can be used.

The light sources 203 are able to be activated in a variety of modes. In the illustrated version, each of the LEDs 203 may be activated in a range of colours or light intensities. The LEDs may also flash or pulse at a range of rates. Relative activation times may be used to indicate information. For example, the LEDs may be activated in a sequence which appears to cause light to chase around the perimeter of the rectangular halo.

In an exemplary scheme, the colour of the LED activations is such that (for example):

(1) Green means below or within a given proximity (for example, within ten percent) of average rate of energy usage relative to (for example) past usage in the household in which the device is located;

(2) Red means above average, above a given threshold value, or exceptionally high rate of energy usage relative to (for example) past usage in the household in which the device is located.

Combined with this, a pulsing rate and/or relative light intensity scheme can be used whereby pulse rate and/or light intensity is proportional (linearly or otherwise) to a variable, such as usage level, such that (for example):

(1) A faster rate of pulsing (and/or brighter lighting) of the rectangular halo indicates (for example) the rate of usage is further from a reference value or is trending upwards;

(2) A slower rate of pulsing (and/or dimmer lighting) of the rectangular halo indicates the rate of usage is at or closer to the reference value or is (for example) trending downwards.

In such an example scheme, a fast pulsing green halo may represent to the user that (for example) their household is using energy at a very low rate. A slow pulsing red halo may represent to the user that (for example) their household is using energy at a rate slightly higher than average.

A further exemplary scheme may use colour to indicate the current rates being applied by an energy provider where (for example):

(1) Green represents that rates are relatively low or discounted, such as below-average rates or rates below particular thresholds;

(2) Orange represents that rates are in a medial or "normal" range, such as falling within a predefined value range or within a given proximity (for example, ten percent) of average rates;

(3) Red represents that rates are relatively high or at a premium, such as above-average rates, rates above particular thresholds, or "peak" rates.

This can be combined with a pulsing scheme indicating level of use where the pulsing speed is associated with the instantaneous power usage for the household when compared to an average value, such that (for example):

(1) Slow pulse rates mean low instantaneous power use;

(2) Fast pulse rates mean high instantaneous power use.

Other colours and activation characteristics may have other meanings, such as showing the status of the hub device. For example:

(1) Magenta may indicate (for example) a normal or operational status display;

(2) Yellow may indicate (for example) low battery.

Combined with a pulse regime whereby (for example):

(1) Continuously on indicates that the hub is starting up and is not yet fully operational.

(2) Pulsing indicates that communication with the IPM cannot be established.

(3) Flashing means user intervention is required or there is otherwise an error or failure.

Any or all of the above schemes could be implemented in any combination as desired to enhance the informational value or usability of the light display.

The exemplary versions of the invention have been described in terms of a residential entity, described as a household. However, the invention may be equally applied to (for example) commercial (such as offices), industrial (such as factories), governmental, or other installations. The term "household" as used herein is thus intended also to cover such entities and installations.

It is also noted that the materials, surfaces, shapes, and textures of the light diffuser 201 and other components can be modified to (for example) vary degrees of transparency, opacity, diffusion, etc., to achieve substantially the same result. It is moreover noted that the halo light need not necessarily extend 360 degrees around to "close" the (rectangular) loop, but rather can wind around and terminate to form (two or more) ends.

It is further noted that although the light diffuser 201 is configured to restrict light emission to the sideways-facing outer edge 204, the light display could be reconfigured such that light is emitted, for example, through a forward-facing halo around the front face of the device.

It is furthermore noted that the exemplary versions depicted above have been discussed in the context of light having a quadrilateral configuration, and in particular, a square one. However, exemplary versions of the above device may have light displays with components that are (for example) polygonal (hexagonal, octagonal, etc.), rounded (circular, oval, ellipse, etc.), etc.

Although the invention has been herein shown and described in what is conceived to be the practical and preferred versions, it is recognised that departures can be made within the scope of the invention, which is not to be limited to the details described herein but is to be accorded the full scope of the appended claims so as to embrace any and all equivalent devices and apparatuses.

What is claimed is:

1. An electronic device including a halo light for communicating messages to a user, a. the device having:

(1) a light diffuser including:

(a) a rim having an outer edge extending around the perimeter of the light diffuser;

(b) an inner lip that is separated from the rim to leave a cavity between the rim and the inner lip, the cavity being bounded in part by an inner surface of the light diffuser;

the rim and inner lip being integrally formed as a unit; and (2) a set of light sources positioned to provide light into the cavity;

b. wherein the light diffuser is configured to reflect and refract light entering the cavity such that light is distributed substantially evenly along the length of the outer edge of the rim.

2. The device of claim 1 wherein the rim is translucent so as to diffuse light passing therethrough.

3. The device of claim 1 wherein the rim further includes an inner wall opposing the outer edge, the inner wall being translucent such that light passing therethrough is diffused.

4. The device of claim 1 wherein the rim is at least substantially square.

5. The device of claim 4 wherein the set of light sources includes eight LEDs, with a. one LED positioned substantially at each of the four corners of the square, and b. one LED positioned along each of the four edges of the square.

6. The device of claim 5 wherein the rim further includes eight indentations positioned to correspond with the positions of the eight LEDs.

7. The device of claim 1 wherein the inner surface and the inner lip are opaque so as to reflect light in the cavity.

8. The device of claim 1 further including a front cover plate and a front bezel, wherein both the light diffuser and the set of light sources are sandwiched between the front cover and the front bezel.

9. The device of claim 8 further including a gap between the front cover plate and the front bezel, the gap defining a void in which the rectangular halo effect is perceived.

* * * * *